United States Patent [19]

Kohler

[11] 4,294,397

[45] Oct. 13, 1981

[54] CARTON WITH SELF ERECTING PARTITIONS

[75] Inventor: Karl A. Kohler, Roselle, Ill.

[73] Assignee: Container Corporation of America, Chicago, Ill.

[21] Appl. No.: 169,192

[22] Filed: Jul. 15, 1980

[51] Int. Cl.[3] ..... B65D 5/48

[52] U.S. Cl. ..... 229/27; 229/15; 229/37 R; 229/38; 229/39 R; 206/216; 206/491; 206/45.19

[58] Field of Search ..... 229/27, 39 B, 41 R, 229/41 B, 10, 15, 28 R, 37 R, 38; 206/216, 491, 45.19

[56] References Cited

U.S. PATENT DOCUMENTS

| | | | |
|---|---|---|---|
| 1,898,231 | 2/1933 | Weiss | 229/27 |
| 2,417,104 | 3/1947 | Cope | 229/37 R |
| 2,464,951 | 3/1949 | Stengren | 206/45.19 |
| 2,517,767 | 8/1950 | Cody | 229/15 |
| 2,866,588 | 12/1958 | Bolding | 229/41 B |
| 3,235,163 | 2/1966 | Hennessey | 229/37 R |
| 3,510,046 | 5/1970 | Reiner | 229/27 |
| 3,563,449 | 2/1971 | Forbes | 229/27 |

*Primary Examiner*—William Price

*Attorney, Agent, or Firm*—R. W. Carpenter; Davis Chin

[57] ABSTRACT

A tubular carton containing automatically self erecting internal longitudinal and transverse partition structures.

2 Claims, 6 Drawing Figures

CARTON WITH SELF ERECTING PARTITIONS

SUMMARY OF THE INVENTION

This invention relates to folding cartons and more particularly to folding cartons of the type having internal partition structures.

The object of the invention is to provide, in a carton of the type described, an internal partition structure which includes a longitudinal partition member and a transverse partition member which automatically fold into proper position when the the carton is erected.

This and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 1:
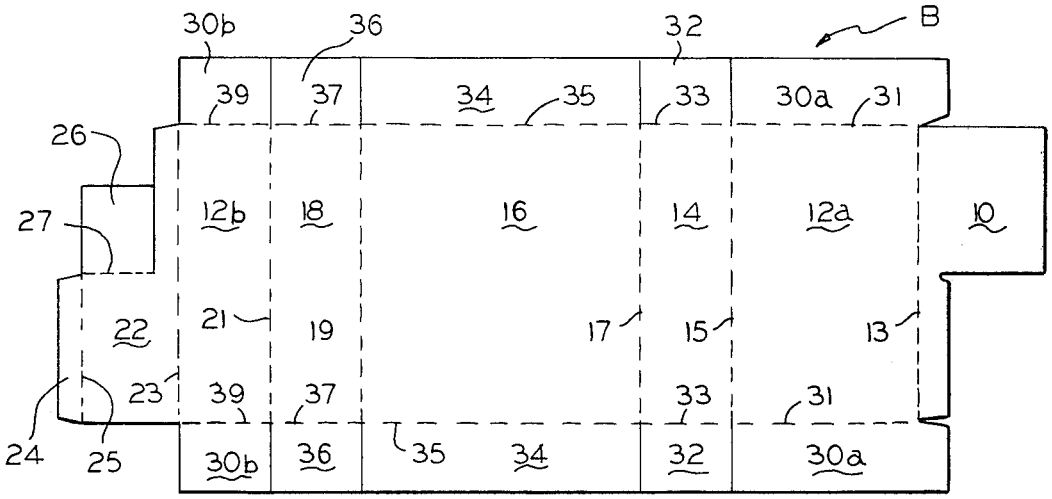
FIG. 1 is a plan view of a blank of foldable sheet material from which the carton illustrated in the other views may be formed.
Figure 6:
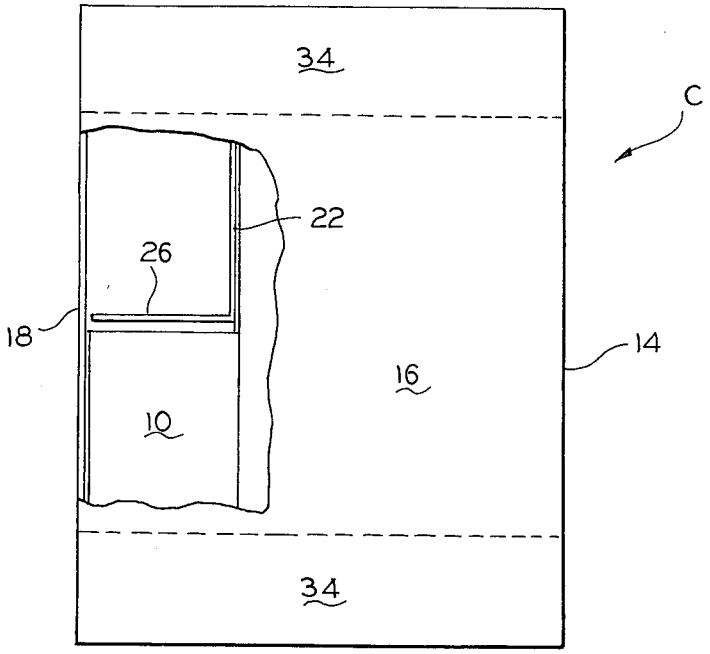
FIG. 6 is a side elevational view of the carton with portions of the structure broken away to reveal the internal partition arrangement.
Figure 5:
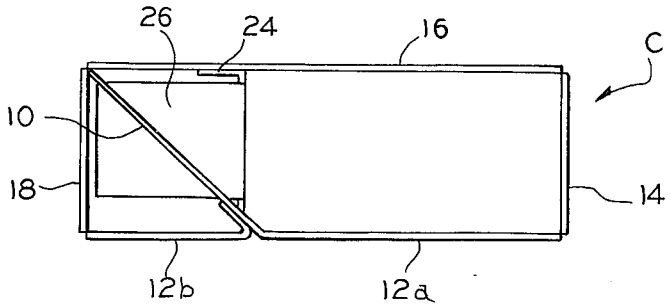
FIGS. 4 and 5 are end elevational views of the carton as seen from opposite ends.
Figure 4:
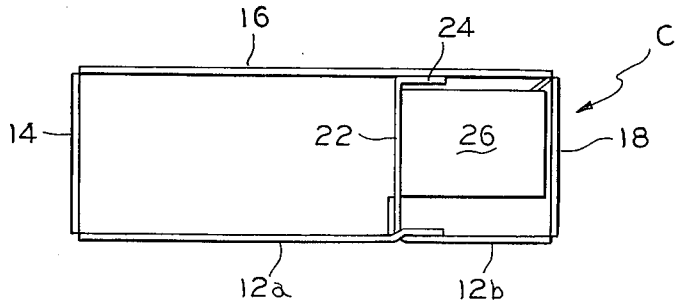

Referring now to the drawings for a better understanding of the invention, it will be seen that a carton C illustrated in FIG. 4–6, having an automatic self erecting internal partition structure, may be formed from the unitary blank B of foldable sheet material illustrated in FIG. 1.

Referring to FIG. 1, it will be seen that the body of the carton includes a first longitudinal partition panel 10, a first major side wall panel section **12*a*, a first minor side wall panel 14, a second major side wall panel 16, a second minor side wall panel 18, another first major side wall panel section 12*b*, a second longitudinal partition panel 22, and a glue flap 24, which are foldably joined to each other along parallel fold lines 13, 15, 17, 19, 21, and 25** respectively.

A transverse partition panel 26 is foldably joined along fold line 27 to an inner edge of second longitudinal partition panel 22 at a location intermediate the ends of panel 22.

Figure 2:
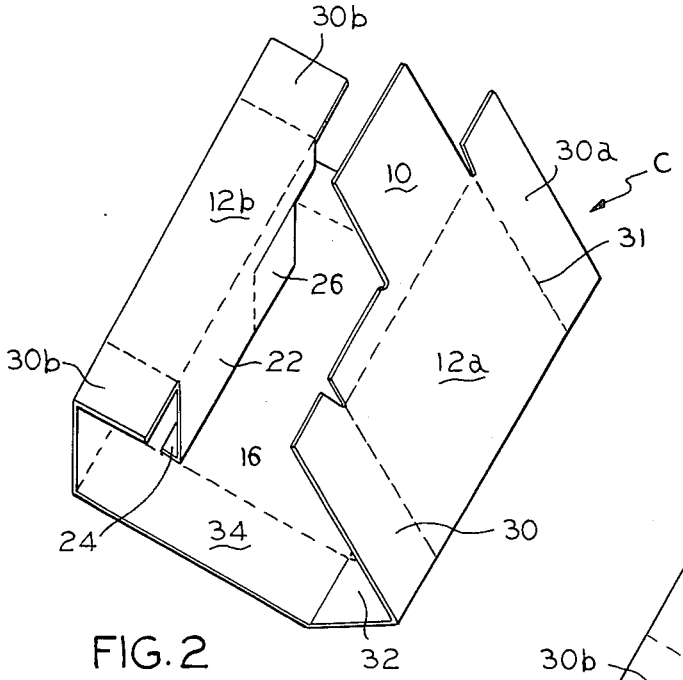
FIGS. 2 and 3 are fragmentary, perspective views illustrating the manner in which the carton is formed by folding the blank into a tubular shape.
Figure 3:
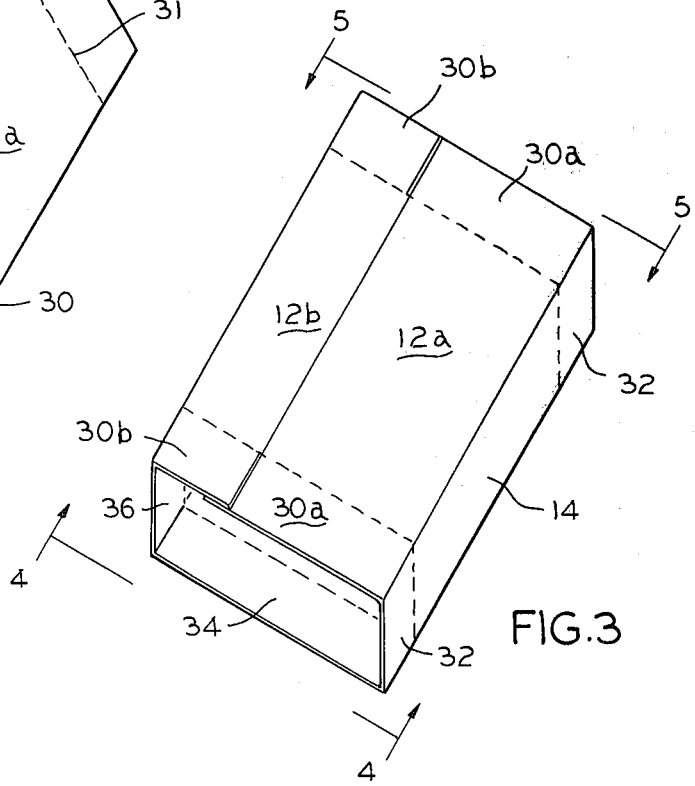

When the carton is formed into a collapsible tubular structure, as seen in FIGS. 2 and 3, first and second longitudinal partition panels 10 and 22 are folded into face-to-face relation, with the narrow portion of first longitudinal partition panel 10 being secured to second longitudinal partition panel 12, and with glue flap 24, which is hinged to second longitudinal partition panel 22, being secured to major side wall panel 16.

Thus, second longitudinal partition panel 22 is disposed to extend between opposed major side walls in parallel relation with adjacent minor side wall panel 18.

As the free end of first longitudinal panel 10 is of a greater width than minor side wall panel 18 and is also free from attachment of either major side wall panel 16 or minor side wall panel 18, when the carton is partially erected from a collapsed condition to a tubular shape, as best seen in FIG. 5, panel 10 is automatically urged to extend diagonally outward toward the junction of major and minor side wall panels 16 and 18, respectively.

As this occurs, transverse partition panel 26, which is disposed between panels 10 and **12*b* when the carton is collapsed, is also automatically urged to move to a lateral position so as to extend outwardly from, and normal to, panel 22 toward minor end wall panel 18, to form a transverse partition which lies against and is supported by diagonally extending panel 10**.

Closure of the ends of the carton may be accomplished by conventional pairs of closure flaps **30*a*, 32, 34, 36, and 30*b* which are foldably joined on fold lines 31, 33, 35, 37, and 39 to opposite ends of panels 12*a*, 14, 16, 18, and 12*b***, respectively, and which are adapted to be secured to each other in overlapped relation.

Thus, it will be understood that the invention provides a novel carton structure having not only a longitudinal portion but also a transverse partition, which automatically folds into position as the carton is erected from a collapsed condition to a tubular condition.

We claim:

1. In a folding carton, formed from a unitary blank of foldable paperboard, including automatically self-erecting interal longitudinal and transverse partition structures, the combination of:

(a) opposed pairs of major and minor side wall panels foldably joined to each other along parallel fold lines to form a tubular structure open at the ends;

(b) opposed pairs of major and minor end closure panels foldably joined to opposite ends of respective major and minor side wall panels, respectively, and adapted to be secured to each other in overlapped relation to close the ends of said carton;

(c) an internal longitudinal partition member including:

(i) a first element secured to and extending between and normal to opposed major side wall panels and disposed parallel to but spaced inwardly from one of said minor side wall panels;

(ii) a second element, having a width greater than that of said first element, secured at one side to one of said major side wall panels in alignment with said first element, and having its other side extending diagonally toward the junction of said other major side wall panel and said one minor side wall panel and being free from attachment to any of said panels;

(d) an internal transverse partition member being:

(i) foldably joined at one end to an edge of said longitudinal element member first element at a location between the ends of said carton and extending transversely from said first element toward said one minor side wall panel between said longitudinal partition member first and second elements;

(ii) supported by an end edge of said longitudinal member second element.

2. A unitary blank of foldable sheet material, such as paperboard, cut and scored to provide a folding carton including longitudinal and transverse partition members which are adapted to automatically move into position as the carton is erected, said blank comprising:

(a) a body portion including the following panels foldably joined one to the other in side-by-side relation along parallel fold lines:

(i) a first longitudinal partition panel;
(ii) one first major side wall panel section;
(iii) a first minor side wall panel;
(iv) a second major side wall panel;
(v) a second minor side wall panel;
(vi) another first major side wall panel section;
(vii) a second longitudinal partition panel;
(viii) a glue flap;

(b) said first longitudinal partition panel including at a first end a relatively narrow portion and at a second end a wider portion which has a transverse dimension greater than that of a minor side wall panel;

(c) said second longitudinal partition panel including at a first end a portion having a transverse dimension equal to that of a minor side wall panel and having at a second end a relatively narrow portion;

(d) a transverse partition panel foldably joined to one end of the first portion of said second longitudinal partition;

(e) closure flaps foldably joined to opposite ends of certain of said panels.

* * * * *